US005299330A

United States Patent [19]

Moore et al.

[11] Patent Number: 5,299,330

[45] Date of Patent: Apr. 5, 1994

[54] EASY-ACCESS SHOWER BASE ASSEMBLY

[75] Inventors: John W. Moore, St. Louis, Mo.; Anthony Buonaura, Bluford, Ill.

[73] Assignee: The Swan Corporation, St. Louis, Mo.

[21] Appl. No.: 968,372

[22] Filed: Oct. 29, 1992

[51] Int. Cl.[5] ..... A47K 3/16

[52] U.S. Cl. ..... 4/604; 4/612

[58] Field of Search ..... 4/604, 555, 605, 609, 4/610, 613, 538, 546, 592, 597, 612, 613; 52/34

[56] References Cited

U.S. PATENT DOCUMENTS

| | | | |
|---|---|---|---|
| 3,551,918 | 1/1971 | Bergmark | 4/613 |
| 3,568,668 | 3/1971 | Neis | 4/604 |
| 3,688,459 | 9/1972 | Mattix | 52/34 |
| 4,757,561 | 7/1988 | Crump | 4/604 |
| 4,777,675 | 10/1988 | Letner | 4/612 |
| 4,899,402 | 2/1990 | Maynard et al. | 4/613 |
| 4,987,619 | 1/1991 | Smith | 4/604 |
| 4,993,087 | 2/1991 | Roguebrune | 4/604 |

*Primary Examiner*—Henry J. Recla

*Assistant Examiner*—Charles R. Eloshway

*Attorney, Agent, or Firm*—Armstrong, Teasdale, Schlafly & Davis

[57] ABSTRACT

An easy access shower base assembly is disclosed which generally comprises a shower base, a ramp, and clips for attaching the ramp to the shower base. The shower base comprises a basin, a generally horizontal front ledge at the front of the basin, with a lip depending downwardly from the front edge of the ledge, and a generally horizontal boundary ledge, vertically higher than the front ledge. The ramp has a thin front edge and a thicker back edge, the thickness of the back edge being less than the height of the lip. The ramp is substantially the same length as the front ledge and the back edge of the ramp is generally even with the front ledge of the shower base. The ramp extends angularly downward from the back edge to the thin front edge. Also in the preferred embodiment, the shower base assembly further comprises at least one water trap for collecting water from the boundary ledge and for causing the collected water to drain into the basin of the shower base.

14 Claims, 3 Drawing Sheets

FIG. 9.
FIG. 8.
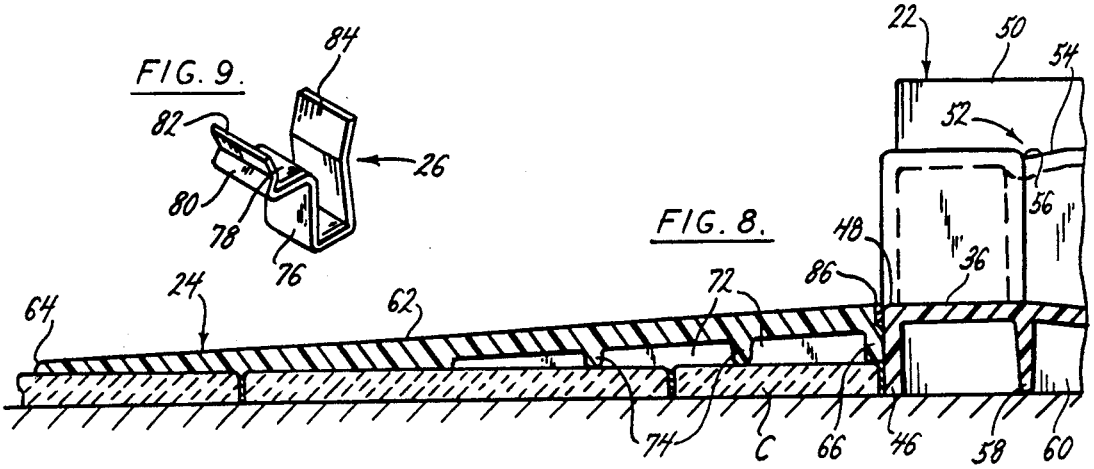
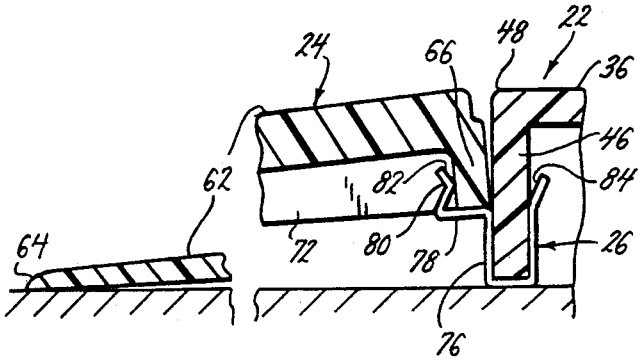
FIG. 11.
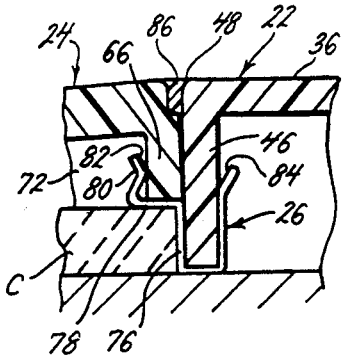
FIG. 10.
FIG. 6.
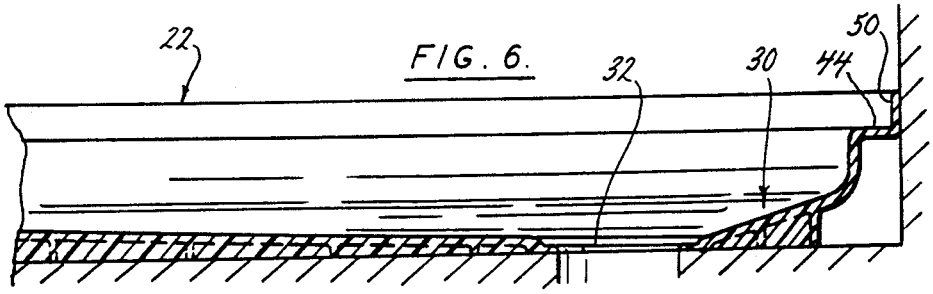
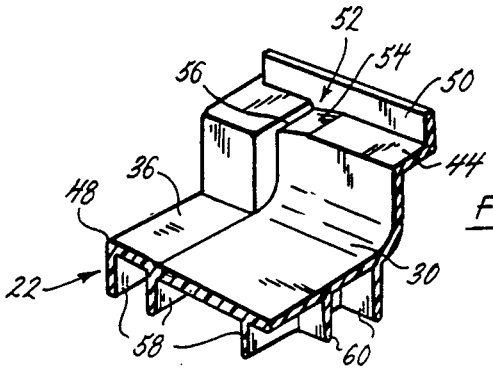
FIG. 7.

EASY-ACCESS SHOWER BASE ASSEMBLY

FIELD OF THE INVENTION

This invention relates to showers, and in particular to an easy-access shower base assembly for handicapped persons, elderly persons, and other physically limited persons.

BACKGROUND AND SUMMARY OF THE INVENTION

There has been an increasing awareness over the past decade of the need to provide public facilities to equally accommodate individuals having physical limitations, such as handicapped persons or elderly persons. Much effort has been directed to providing private and public products or facilities that allow physically limited persons to utilize the products or facilities with little or no assistance from others. For example, public buildings have been retrofitted with entrances that allow physically disabled persons to enter the facility without assistance by providing entrances without staircases.

It is generally known that most physically limited persons prefer independence and autonomy of action like non-physically limited persons. Nowhere is this more true than in areas where the physically disabled person attends to personal hygiene needs such as bathing.

Conventional bathtubs with a shower have a front wall which users must step over in order to get into and out of the bathtub. This type of bathtub is found in most residences and is provided in most hotels and motels. It is extremely difficult, if not impossible, for many disabled persons to step over the front wall of a conventional bathtub. Further, even where a physically disabled person can manage to step over the front wall of the bathtub, such a maneuver poses the threat of serious injury due to a fall. However, retrofitting a conventional bathroom to better accommodate the physically limited can be difficult and expensive. There are difficulties in constructing suitable bathing facilities in the confined space of a bathroom and in accommodating existing flooring.

The present invention is directed to an easy-access shower base assembly which is adapted to replace a conventional bathtub so that physically limited persons can more easily get into and out of the shower. The easy-access shower base assembly comprises a shower base, a ramp leading up to the front ledge of the shower base, and at least one clip for attaching the ramp to the shower base.

The shower base comprises a rectangular basin which is substantially the same size as a conventional bathtub. The basin has a drain opening adjacent one end, as with traditional bathtubs, and the surface of the basin slopes gradually toward the drain opening to allow water to drain from the basin. The shower base further comprises a generally horizontal front ledge at the front of the basin which is at a much lower elevation than the front wall of a conventional bathtub. A lip depends downwardly from the front edge of the front ledge. The shower base further comprises a second generally horizontal ledge that surrounds the basin at the sides and back. The second horizontal ledge is vertically higher than the front ledge.

The shower base further comprises at least two water ducts for draining water collecting on the second ledge into the basin, thereby preventing it from running off the front of the base. The water ducts are preferably grooves formed in the second ledge on the sides of the base, generally adjacent the front ledge of the base. The second ledge preferably slopes gradually toward the water ducts, to facilitate water drainage.

The ramp has a thin front edge, and a thicker back edge which abuts the lip of the shower base. The ramp is substantially the same length as the front ledge of the shower base and slopes downwardly from the thicker back edge to the thin front edge.

In the preferred embodiment, at least one clip secures the ramp to the lip, and supports the back edge of the ramp in an elevated position so that the top surface of the back edge of the ramp is generally even with the surface of the front ledge of the base, with a space below the back edge of the ramp and in front of the lip to accommodate the thickness of the bathroom floor covering.

The shower base can be readily retrofit into the existing bathtub space, without reconfiguring the bathroom. The ramp provides a smooth transition into the basin accessible to those with physical limitations, and even persons in wheel chairs. The clips hold the ramp in place, with the rear edge of the ramp elevated. Thus the assembly can be retrofit in a bathroom with an existing floor covering in front of the base, or a new floor covering can be installed in front of the base, or the assembly can be installed over an existing or new floor covering, permitting greater flexibility in design, and providing greater economy by allowing the existing flooring to be used.

These and other features and advantages will be in part apparent and in part pointed out hereinafter.

BRIEF DESCRIPTION OF THE DRAWINGS

FIG. 6 is an enlarged partial longitudinal cross-sectional view of the shower base showing the drain;

FIG. 7 is an enlarged view of one of the water ducts;

FIG. 8 is a partial transverse cross-sectional view of the ramp taken along the plane of line 8—8 in FIG. 1;

FIG. 9 is a perspective view of one of the clips that connect the ramp to the lip of the shower base and support the back edge of the ramp;

FIG. 10 is a partial transverse cross-sectional view of the connection between the ramp and shower base taken along the plane of line 10—10 in FIG. 1, showing floor covering under the ramp in front of the shower base; and FIG. 11 is a transverse cross-sectional view of the connection between the ramp and shower base as in FIG. 10, where there is no floor covering under the ramp in front of the shower base.

Corresponding reference numerals indicate corresponding parts throughout the several views of the drawings.

DETAILED DESCRIPTION OF THE PREFERRED EMBODIMENT

Figure 1:
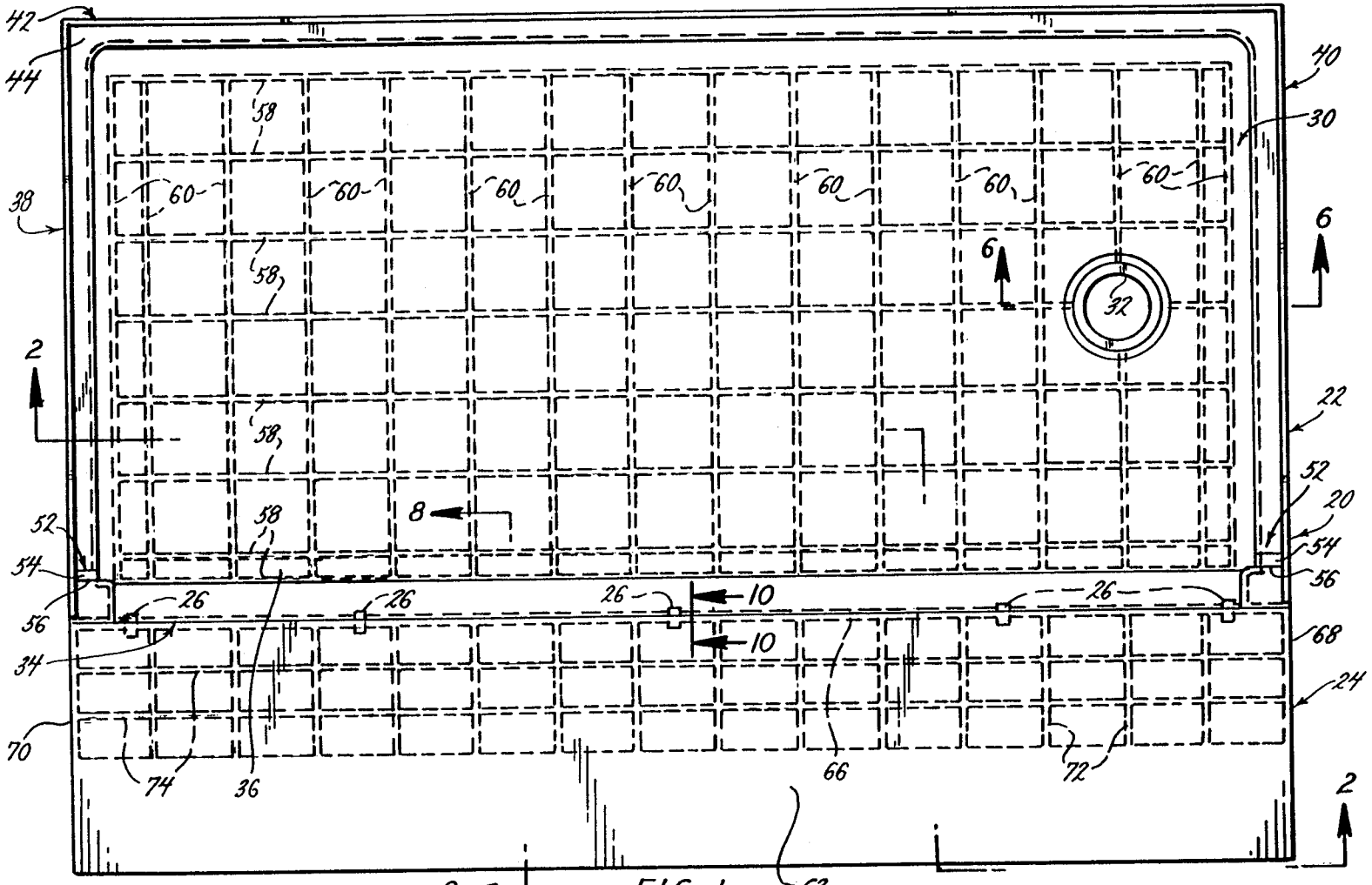
FIG. 1 is a top plan view of an easy-access shower base assembly constructed according to the principles of this invention.
Figures 2, 3, 4, 5:
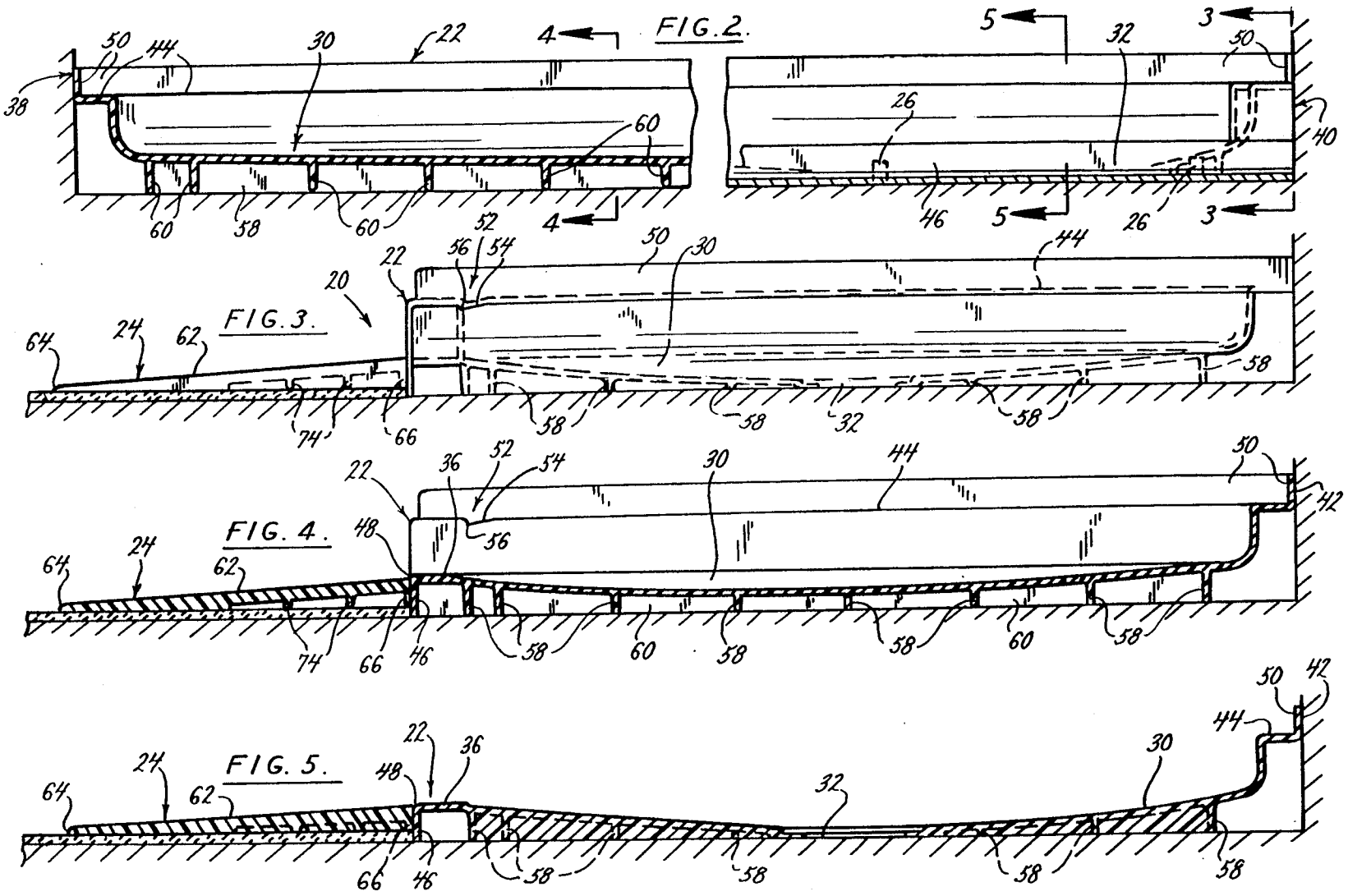
FIG. 2 is a partial longitudinal cross-sectional view, and partial front elevation view, taken along line 2—2 in FIG. 1.
FIG. 3 is a transverse cross-sectional view of the shower base and ramp taken along the plane of line 3—3 in FIG. 2.
FIG. 4 is a transverse cross-sectional view of the shower base and ramp taken along the plane of line 4—4 in FIG. 2.
FIG. 5 is a transverse cross-sectional view of the shower base and ramp taken along the plane of line 5—5 in FIG. 2.

The easy-access shower base assembly of the present invention is indicated generally as 20 in the Figures. The shower base assembly 20 generally comprises a shower base 22, a ramp 24, and clips 26 for securing the ramp 24 to the shower base 22.

The shower base 22 is preferably the same length and width as a conventional standard bathtub, so that the shower base can be installed in the opening left by the removal of such a bathtub. The shower base 22 comprises a shallow, generally rectangular basin 30, having a drain opening 32 therein, adjacent one side. The basin 30 is configured to slope gradually toward the drain opening 32. The basin 30 is bounded at the front 34 by a generally horizontal front ledge 36, and at the sides 38 and 40 and the back 42, by a boundary ledge 44. The boundary ledge 44 is vertically higher than the front ledge 34. A lip 46 extends generally downwardly from the front edge 48 of the front ledge 34. A splash board 50 projects vertically upwardly from the outer edge of the second ledge 44. The splash board 50 is relatively thin, so that tile, or the panels of a pre-formed shower enclosure can overlap the splash board to prevent leaks. All of the elements of the base 22 are preferably formed integrally, for example with molded polyesters, acrylics, or other suitable polymers.

The boundary ledge 44 preferably slopes toward the front 34 of the shower base, and there is at least one, and preferably two, water traps 52 in the ledge to drain water that collects on the ledge 44 into the basin 30. The traps comprise a downwardly, forwardly sloped portion 54, forming a inwardly sloping channel 56, draining into the basin.

The underside of the base 22 has latticework of longitudinally extending ribs 58 and transversely extending ribs 60, to strengthen the base while leaving it relatively lightweight and easy to handle.

As described above, the front ledge 36 is lower than the boundary ledge 44, to facilitate access to the basin 30 over the front ledge by physically disabled persons. Nonetheless, so that the basin is sufficiently deep to retain shower water, the front ledge 36 is elevated from the floor sufficiently that for many disabled persons access to the basin 30 might still be difficult. The ramp 24 can be installed at the front of the shower base 22 to facilitate access to the basin 30. The ramp 24 has a generally smooth top surface 62, a thin front edge 64, a thicker back edge 66, and tapering sides 68 and 70. Like the base 22, the ramp preferably has a latticework of longitudinally extending ribs 72 and transversely extending ribs 74 to strengthen the ramp while leaving it relatively light-weight and easy to handle.

The ramp is preferably the same length as the length of the front ledge 36, to provide access to the basin along the entire length of the front ledge.

In this preferred embodiment, the ramp 24 is connected to the shower base 22 with a plurality of clips 26. The precise number of clips can vary depending upon their size, configuration, and placement. Referring to FIGS. 10 and 11, a clip 26 is shown connected the ramp 24 to the lip 46 of the shower base 22. The clip 26 secures the ramp 24 to the lip 46, and also supports the back edge 66 of the ramp 24 in an elevated position so that the back edge of the top surface 62 of the ramp is generally even with the front ledge 36 of the shower base 22, with a space below the back edge 66 of the ramp and in front of the lip 46 to accommodate the thickness of a floor covering C over a floor F (as shown in FIG. 10). However, the clip 26 also supports the ramp 24 in the absence of floor covering C (as shown in FIG. 10) to provide a smooth, continuous access to the basin 30 regardless of whether or not floor covering is present, and regardless of its thickness.

The clip 26, as shown in FIG. 9 has a complex configuration with a U-shaped section 76 for receiving the front lip 46 of the shower base 22. A shelf 78 projects from the front of the clip for supporting the back edge 66 of the ramp 24. The height of the shelf 78 relative to the bottom of the U-shaped portion is such that the clip supports the ramp sufficiently above the bottom edge of the lip to accommodate the thickness of a floor covering, such as tile, in front of the lip 46 (see FIG. 10). However, the shelf is sufficiently strong to support the ramp even when there is no floor covering in front of the lip 46 (see FIG. 11). The front edge of the shelf has a retaining lip 80 for engaging the back edge 66 of the ramp and securing it to the shower base 22. The front and back sides of the clip have sloped brims 82 and 84, respectively, for facilitating the placement of the clip over the lip 46 of the shower base 22 and the engagement of the back edge 66 of the ramp in the clip. The clip 26 permits some relative flexing movement between the base 22 and ramp 24, to accommodate installation with or without a floor covering in front of the base.

The shower base assembly of this invention is particularly adapted for retrofitting in the place of a conventional standard bathtub, but the assembly can also be used in new installations. The existing tub is removed. The existing floor tile or other covering can either be removed or left in place. If the floor covering is left in place, the floor covering will usually extend up to the front wall 46 of the shower base 22 after it is installed, diminishing the apparent height of the front lip by the thickness of the floor covering. If the floor covering is removed, the apparent height of the lip 46 of the shower base 22 after it its installed is its actual height.

The shower base 22 is installed, and the drain opening 32 is connected to the drain, as is know in the art. The clips 26 are secured on the front lip 46 of the shower base 22, generally evenly spaced along the length. The shelves 78 of the clips project forwardly of the lip 46. The back edge 66 of the ramp is inserted into the clips 26. The shelves 78 support the back edge of the ramp so that there is a smooth transition between the back edge of the top surface 62 of the ramp, and the front ledge 34, regardless of whether there is floor covering in front of the lip to support the ramp (see FIG. 11). The shelves 78 of the clips 26 are sufficiently high to accommodate the thickness of most conventional floor coverings (see FIG. 10). The ramp can be easily removed from, and reinstalled in, the clips to facilitate cleaning. A bead 86 of caulk can be provided to seal the gap between the base 22 and the ramp 24.

OPERATION

In retrofitting a bathroom for improved access by the physically disabled, the existing bathtub is removed. The shower base 22 is the same length and width as the conventional bathtub, and fits within the space formerly occupied by the bathtub. The clips are installed on the front lip 46 of the base 22. The drain is connected, and wall covering is placed over the splash board 50. Depending upon the condition of the floor covering, it may be left in place or removed and replaced, in which case, as shown in FIG. 10, the lip projects upwardly above the surface of the floor covering C, a distance less than its actual height. The clip 26 holds the ramp 24 at its proper height, regardless of the thickness of the floor covering C. Alternatively, the base 22 can be installed on top of the original or a replacement floor covering, in which case the lip projects upwardly above the surface of the floor covering its true height. In this case, the clips 26 allow the ramp to slope more sharply downwardly, while supporting the back of the ramp at the proper height so that there is a smooth transition between the surface 62 of the ramp and the front ledge 36. (Compare FIG. 11, where the ramp slopes more sharply downwardly, with FIG. 10).

In view of the above, it will be seen that the several objects of the invention are achieved and other advantageous results attained.

As various changes could be made in the above constructions without departing from the scope of the invention, it is intended that all matter contained in the above description or shown in the accompanying drawings shall be interpreted as illustrative and not in a limiting sense.

What is claimed is:

1. An easy-access shower base assembly adapted to replace an existing bath tub, comprising:

a shower base comprising:

a rectangular basin substantially the same size as a conventional bath tub, the basin having a bottom surface, a front, a back, vertical sides extending from said bottom surface, and drain opening adjacent one end, the bottom surface of the basin sloping gradually toward the drain opening;

a generally horizontal front ledge at the front of the basin, with a lip depending downwardly from the front edge of the ledge; and a generally horizontal boundary ledge, vertically higher than the front ledge, surrounding the basin at the sides and the back;

a ramp, substantially the same length as the front ledge, for providing access to the basin over the front ledge, the ramp having a thin front edge and a thicker back edge, the thickness of the back edge being less than the height of the lip; and means for securing the ramp to the shower base and for supporting the back edge of the ramp in an elevated position so that the top of the back edge of the ramp is generally even with the front ledge, with a space below the back edge of the ramp and in front of the lip to accommodate the thickness of a floor covering.

2. The shower base assembly of claim 1 wherein the securing means comprises at least one clip for retaining the back edge of the ramp against the lip of the shower base.

3. The shower base assembly of claim 2 wherein the clip comprises means for securing itself to the lip, a support for elevating and supporting the back edge of the ramp, and retention means for preventing the back edge of the ramp from moving away from the lip of the shower base.

4. The shower base assembly of claim 3 wherein the lip securing means comprises a substantially U-shaped clip section, and the support comprises a shelf projecting from the U-shaped clip section and the means for retention comprise a clip extending upwardly from the shelf.

5. The shower base assembly of claim 1 wherein the assembly further comprises at least one water trap for collecting water from the boundary ledge and for causing the collected water to drain into the basin of the shower base.

6. The shower base of claim 5 wherein there are two water traps formed in the boundary ledge on the sides of the basin adjacent the front ledge.

7. The shower base assembly of claim 6 wherein the water traps are notches formed in the boundary ledge on the sides of the basin.

8. An easy-access shower base assembly adapted to replace an existing bath tub, comprising:

a shower base comprising:

a rectangular basin substantially the same size as a conventional bath tub, the basin having a bottom surface, a front, a back, vertical sides extending from said bottom surface, and drain opening adjacent one end, the bottom surface of the basin sloping gradually toward the drain opening;

a generally horizontal front ledge at the front of the basin, with a lip depending downwardly from the front edge of the ledge; and a generally horizontal boundary ledge, vertically higher than the front ledge, surrounding the basin at the sides and the back;

a ramp, connected to the shower base and substantially the same length as the front ledge, for providing access to the basin over the front ledge, the ramp having a thin front edge and a thicker back edge, the thickness of the back edge being less than the height of the lip; and at least one clip for securing the ramp to the lip, and for supporting the back edge of the lip in an elevated position so that the back edge of the ramp is generally even with the front ledge, with a space below the back edge of the ramp and in front of the lip to accommodate the thickness of a floor covering.

9. The shower base assembly of claim 8 wherein the clip comprises means for securing itself to the lip, a support for elevating and supporting the back edge of the ramp, and retention means for preventing the back edge of the ramp from moving away from the lip of the shower base.

10. The shower base assembly of claim 9 wherein the lip securing means comprises a substantially U-shaped clip section, and the support and the means for retention comprise a substantially J-shaped clip section.

11. An easy-access shower base assembly adapted to replace an existing bath tub, comprising:

a shower base comprising:

a rectangular basin substantially the same size as a conventional bath tub, the basin having a bottom surface, a front, a back, vertical sides extending from said bottom surface, and drain opening adjacent one end, the bottom surface of the basin sloping gradually toward the drain opening;

a generally horizontal front ledge at the front of the basin, with a lip depending downwardly from the front edge of the ledge; and a generally horizontal boundary ledge, vertically higher than the front ledge, surrounding the basin at the sides and the back;

a ramp, substantially the same length as the front ledge, for providing access to the basin over the front ledge, the ramp having a thin front edge and a thicker back edge, the thickness of the back edge being less than the height of the lip;

means for securing the ramp to the shower base and for supporting the back edge of the ramp in an elevated position so that the top of the back edge of the ramp is generally even with the front ledge, with a space below the back edge of the ramp and in front of the lip to accommodate the thickness of a floor covering; and at least two water traps for collecting water from the boundary ledge and for causing the collected water to drain into the basin of the shower base.

12. The shower base assembly of claim 11 wherein the water traps are notches formed in the boundary ledge on the sides of the basin.

13. The shower base of claim 12 wherein the water traps are formed in the boundary ledge on the sides of the basin adjacent the front ledge.

14. The shower base assembly of claim 13 wherein the securing means comprises at least one clip.

* * * * *